United States Patent [19]

Wilhelm

[11] Patent Number: 4,523,510

[45] Date of Patent: Jun. 18, 1985

[54] COMBINED SELECTOR, SAFETY AND TRIGGER ASSEMBLY FOR AUTOMATIC FIREARMS

[75] Inventor: Gary Wilhelm, Hamden, Conn.

[73] Assignee: Demro Products, Inc., Manchester, Conn.

[21] Appl. No.: 434,580

[22] Filed: Oct. 15, 1982

[51] Int. Cl.[3] ..... F41D 11/02

[52] U.S. Cl. ..... 89/141; 89/142

[58] Field of Search ..... 89/142, 141, 145, 140

[56] References Cited

U.S. PATENT DOCUMENTS

| | | | |
|---|---|---|---|
| 1,437,889 | 12/1922 | Eickhoff | 89/141 |
| 2,342,824 | 2/1944 | Swebilius | 89/142 X |
| 2,587,460 | 2/1952 | Gaidos | 89/140 |

FOREIGN PATENT DOCUMENTS

| | | | |
|---|---|---|---|
| 125139 | 4/1919 | United Kingdom | 89/140 |
| 748828 | 5/1956 | United Kingdom | 89/140 |

*Primary Examiner*—Stephen C. Bentley
*Assistant Examiner*—John S. Maples

[57] ABSTRACT

A full automatic firearm or submachine gun has a combined trigger, sear and selector mechanism including automatic and semi-automatic bars which are pivoted at their forward end to the trigger, and a sear member disposed therebetween and independently pivotably mounted. A selector member is pivotable among safe, semi-automatic and full automatic fire positions, and is engageable with the bars to effect their pivotal movement as required and is engageable with the sear to prevent its movement in the safe position. The semi-automatic bar, automatic bar and sear have means which are engageable to pivot the sear from engagement with the bolt upon pulling of the trigger, but only one bar is so engaged at any one time. Biasing means bias the sear, semi-automatic bar, automatic bar and trigger to their respective initial or at rest positions.

19 Claims, 19 Drawing Figures

COMBINED SELECTOR, SAFETY AND TRIGGER ASSEMBLY FOR AUTOMATIC FIREARMS

BACKGROUND OF THE INVENTION

Firearms which are capable of full automatic fire are often provided with mechanisms which will permit them to be fired semi-automatically, i.e., only one shot each time a trigger is pulled. This is particularly true with firearms of the type referred to as submachine guns. Moreover, it is generally desirable to provide all firearms with safety means for locking the bolt so that it cannot be released to fire a cartridge in the chamber.

Accordingly, many automatic firearms include selector means which will permit the bolt to be locked in the safe position, and which will provide control over the sear mechanism to permit either full automatic fire or semi-automatic fire. In some instances, this entails a change in trigger position; in other instances, it entails a plurality of separate "switches" or controls. In some firearms, combinations of automatic and semi-automatic bars engaged with the sear are acted upon by the selector mechanism to effect their movement to alternate positions.

It is an object of the present invention to provide a full automatic firearm employing a novel and highly effective trigger, sear and selector mechanism to permit the bolt to be locked in a safe position and to be fired either automatically or semi-automatically.

It is also an object to provide such a firearm wherein the sear is engaged at any one time only with one of a pair of bars which control its movement in response to operation of the trigger.

Another object is to provide such a firearm in which the sear, trigger and selector mechanism is contained in a unitary assembly or a single housing unit readily attached or assembled to the receiver or firearm body.

A further object is to provide such a firearm wherein the parts may be readily and economically fabricated and assembled, and which will exhibit long life and operate in a relatively trouble-free manner.

SUMMARY OF THE INVENTION

It has now been found that the foregoing and related objects and advantages can be readily attained in a firearm of the type having a receiver with an aperture in its bottom wall, and a bolt which reciprocates within the receiver. A housing is affixed at its upper end to the bottom of the receiver and has spaced sidewalls depending therefrom and defining a cavity therewithin, and the aperture on the bottom wall of the receiver communicates with the upper portion of the housing cavity.

An elongated trigger member is pivotally mounted between the sidewalls of the housing by pivot means. Also in the housing cavity is a sear member with a sear projection on its upper surface, and pivot means pivotally mount the sear member between the sidewalls of the housing for pivotal movement from a first position wherein the sear projection extends upwardly through the aperture into the receiver for engagement with the bolt and to a second position wherein the sear projection is disposed below the receiver and is not engageable with the bolt.

A semi-automatic bar is located in the housing cavity to one side of the sear member and has a cam surface on its upper edge portion, and is pivotally mounted by pivot means within the housing cavity for movement between a first position in which the semi-automatic bar extends through the receiver aperture to locate the cam surface in the receiver for engagement by the bolt and a second position in which the bar is disposed below the receiver and is not engageable with the bolt.

Also in the housing cavity is an automatic bar located on the other side of the sear member, and it is pivotally mounted by pivot means in the cavity for movement between a first position and a second position.

Cooperating engagement means on the sear member and on the automatic bar interengage in the second position of the automatic bar. Cooperating means on the sear member and on the semi-automatic bar effects engagement therebetween and concurrent movement of the sear member with the semi-automatic bar during initial movement of the semi-automatic bar from its one position thereof to its second position, and the cooperating means disengage during such movement to release the sear member for return to its first position. The bars are engaged with the trigger member by suitable means for movement thereof from their first and second positions upon pulling of the trigger.

A selector member is provided in the housing cavity and has a body and a cam portion, and its body is pivotally mounted for rotation about an axis among three positions. One of these positions is a safe position wherein the cam portion is disposed in close proximity below the sear member to prevent its pivoting from its first position to its second position. A second pivoted position is one in which the cam portion is pivoted into a position permitting the sear member to pivot into its second position in response to movement of the trigger to its second position. Thus, the firearm may fire semi-automatically with the semi-automatic bar being cammed downwardly during forward movement of the bolt, and the sear member is released to pivot to its first position to engage the bolt when it returns. A third position is one in which the cam portion engages the semi-automatic bar and the automatic bar to pivot them into their respective second positions in which position thereof pivoting of the trigger to its second position pivots the sear member into its second position by its engagement with the automatic bar and permits continuous reciprocation of the bolt so long as the trigger is retained in its second position and there are cartridges in the magazine.

In the preferred embodiment, the selector member has a body portion which is pivotally mounted and an arm portion extending therefrom and providing the cam portion. Desirably, the arm portion has a convexly arcuate cam surface at its outer end. The line of action defined by the axis of the pivot means for the selector member and the center for the arc of the cam surface is angled from the vertical towards the rear of the firearm in the safe position and angled from the vertical towards the forward end of the firearm in the semi-automatic and automatic positions thereof.

Desirably, the selector member has means thereon disengageably interlocking with the sidewalls of the housing in each of its several positions. The selector member has a locking element on its pivotal mounting means outwardly of the receiver housing and interlocking with the receiver housing in the full automatic position of the selector. Preferably, this comprises a selector lever on the pivotal mounting means outwardly of the receiver housing on one side thereof and an end cap on the pivotal mounting means on the other side of the receiver housing.

Desirably, the semi-automatic bar has a pivot portion at its forward end and upper and lower arm portions on its rearward end. The lower arm portion has a recess therein and the sear member has a projection thereon seatable in this recess to provide the cooperating means to effect engagement therebetween. Preferably, the rear surface of the semi-automatic bar between the arm portions is curvilinear and the projection travels therealong upon release from the recess.

In its preferred aspect, the automatic bar has a recess adjacent its upper edge and the sear member has a projection engageable in this recess when the bar is in the second position thereof and the trigger is pulled.

To effect movement of both bars to the automatic position of the selector member, both the automatic and semi-automatic bar have a rearwardly extending arm portion, and the selector member cam portion is engageable with these arm portions during its movement to its third position to effect pivoting thereof to their second positions. The bar members are pivotally mounted on the trigger at a point above the pivotal means for the trigger whereby pulling of the trigger effects movement thereof in the direction of the trigger to effect counterclockwise pivoting thereof. The assembly desirably includes spring means acting between the trigger and the bars to bias the trigger in a clockwise direction and bias the bars in a counterclockwise direction. Additionally, there is included means biasing the sear member in a counterclockwise direction and into the receiver for engagement with the bolt.

In the preferred embodiment, the trigger is of generally U-shaped cross section providing a channel opening towards the bars and the pivotal connection of the bars to the trigger comprises a pivot pin upon which is mounted the biasing means in the trigger channel.

Significantly, only one of the automatic and semi-automatic bars has its cooperating means engaged with the sear member at any given position of the sear member.

DETAILED DESCRIPTION OF THE ILLUSTRATED EMBODIMENT

Figure 1:
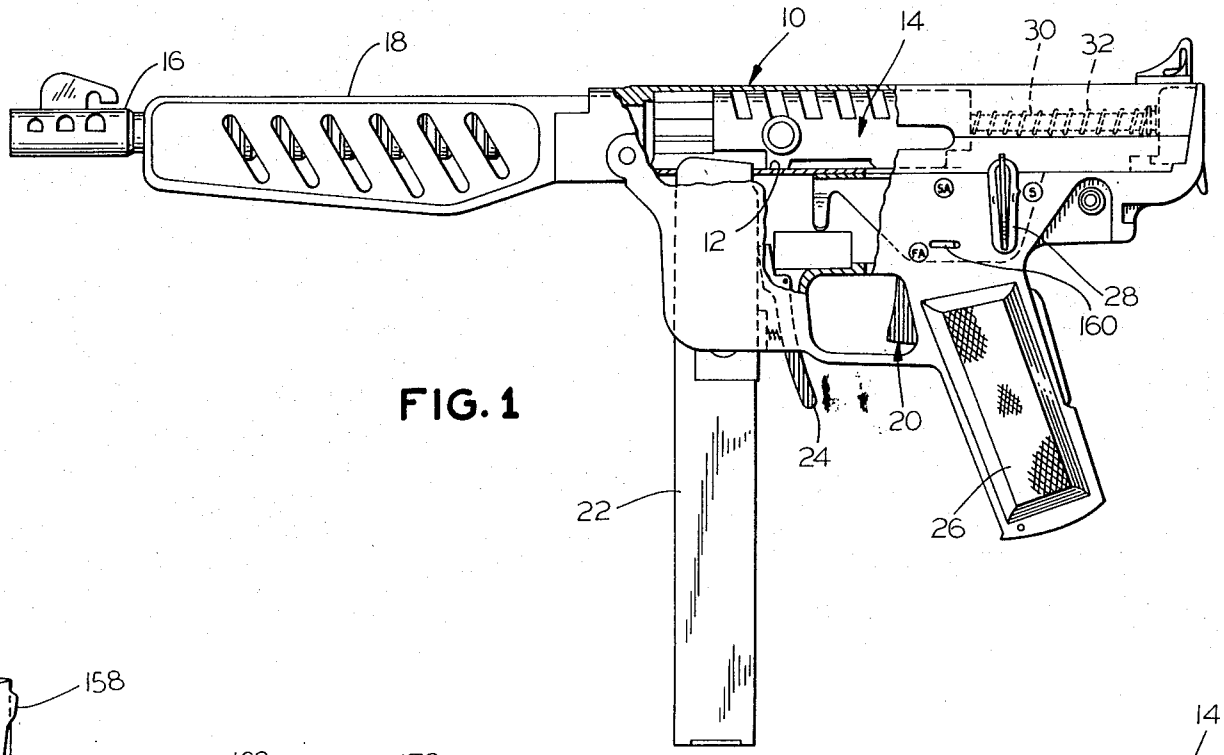
FIG. 1 is a side elevational view of a select fire automatic carbine or submachine gun embodying the present invention with portions broken away to reveal internal construction and other internal portions in phantom line.

Turning first to FIG. 1, therein illustrated is a select fire automatic carbine or submachine gun embodying the present invention and generally comprised of a top receiver or receiver housing generally designated by the numeral 10 having the receiver cavity 12 therewithin, and in which cavity 12 reciprocates a bolt generally designated by the numeral 14.

Extending from the front of the receiver housing 10 are the barrel 16 and the louvered forearm 18 which extends thereabout. Below the receiver cavity 12 is the trigger generally designated by the numeral 20, the magazine 22 and its release lever 24, and a pistol grip 26. On the side of the receiver housing 10 is a selector switch lever 28. Shown in phantom line are the bolt guide ejector rod 30 and the ejector rod spring 32 thereabout. Various other elements of the structure which are conventional are not specifically identified since their function and interrelationship will be readily apparent to those of ordinary skill in the art.

Figure 3:
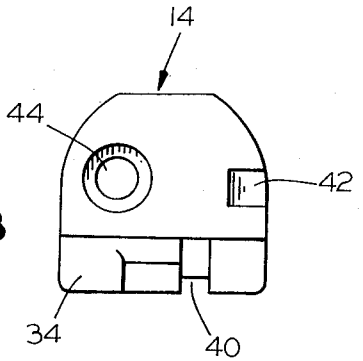
FIG. 3 is a rear elevational view of the bolt.
Figure 6:
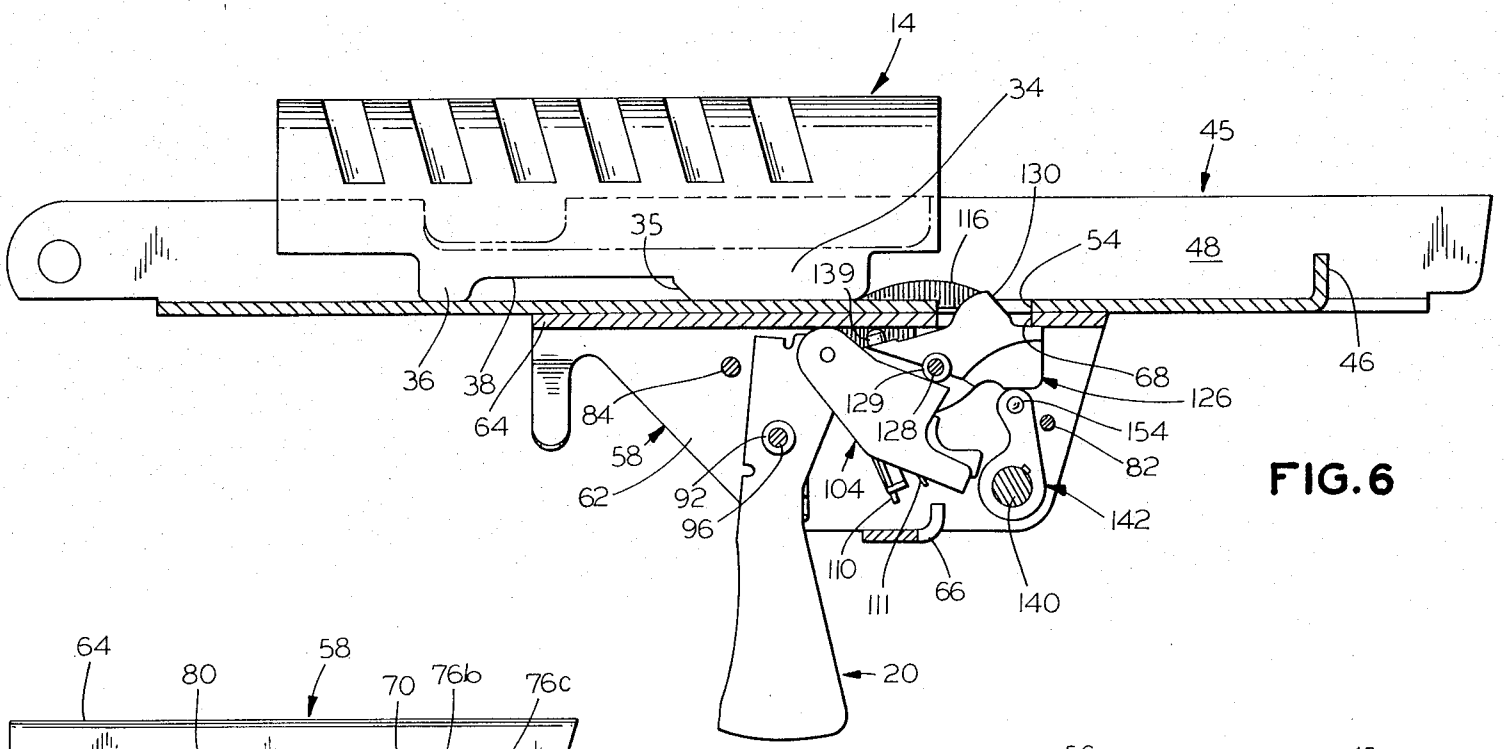
FIG. 6 is a side elevational view in partial section of the bottom receiver, bolt, trigger, sear and selector mechanism; with the parts shown in the "safe" position of the selector mechanism.

Turning next to FIGS. 3 and 6, it can be seen that the bottom portion of the elongated bolt 14 is configured to provide a first or rear leg 34 spaced from its rearward end and having an arcuate cam surface at its lower rearward portion. The bottom portion of the bolt 14 also has a second or front leg 36 spaced from its forward end, and the two legs 34, 36 define a sear receiving cavity 38 therebetween. Extending through both legs 34, 36 is a narrow, vertical channel 40, and, as seen in FIG. 3, one side of the bolt 14 has a longitudinally extending channel or guideway 42 intermediate its vertical dimension. Also seen in FIG. 3 is the bore 44 which seats the guide ejector rod 30.

Figure 8:
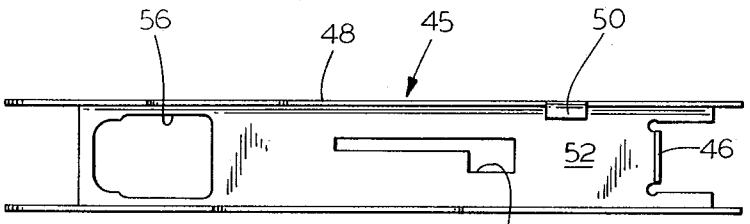
FIG. 8 is a plan view of the bottom receiver.

As seen in FIGS. 6 and 8, the bottom wall 52 of the bottom receiver generally designated by the numeral 45 has an upstanding arm 46 which functions as a stop for the bolt 14 in its rearward movement, and its sidewall 48 has a horizontally extending guide finger 50 which is slidably disposed in the channel or guideway 42 of the bolt 14. The bottom wall 52 of the bottom receiver 45 also has a L-shaped aperture 54 therethrough defined by a relatively wide rear portion and elongated, forwardly extending side portion. Also provided in the bottom wall 52 is an aperture 56 for the magazine 22 to feed cartridges (not shown) into the receiver cavity 12 and into the barrel chamber (not shown) forwardly of the bolt 14.

Figure 7:
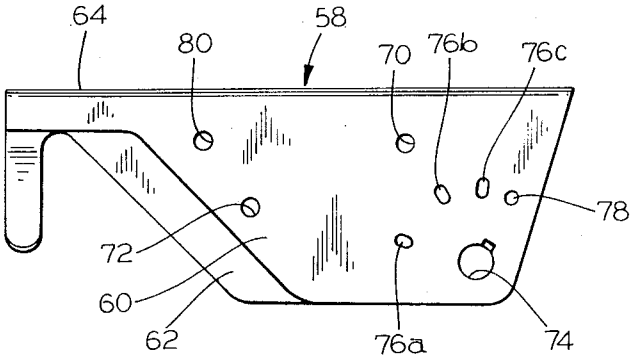
FIG. 7 is a side elevational view of the trigger frame.
Figure 15:
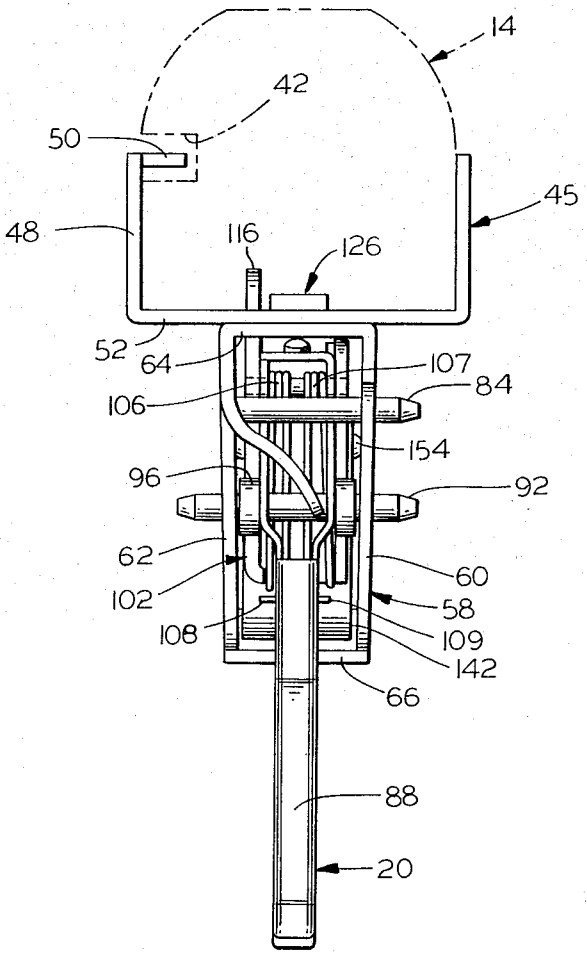
FIG. 15 is a front elevational view of the subassembly of bottom receiver, bolt, trigger, sear, bars and selector, and with the bolt shown in phantom line.

Turning now to FIGS. 6, 7 and 15, therein illustrated is the trigger frame generally designated by the numeral 58 and defined by a pair of sidewalls 60, 62, the transverse top wall 64 and a transverse arm 66 at its base. The top wall 64 has an L-shaped aperture 68 therein which is aligned with the aperture 54 in the bottom receiver 45. The side walls 60, 62 have aligned pivot pin apertures 70 and 72, and aligned selector shaft apertures 74 with that in the sidewall 60 being of keyhole configuration. Spaced on an arc about the upper forward portion of selector shaft apertures 74 are three detent apertures 76*a*, 76*b*, and 76*c* in the sidewalls 60, 62, for a purpose to be described more fully hereinafter. In addition, the sidewalls 60, 62 have aligned apertures 78, 80 in which are seated stop rods 82, 84 extending therebetween to strengthen the assembly and to provide stops for the selector 142 and trigger 20 which pivot adjacent thereto.

Figures 4, 5:
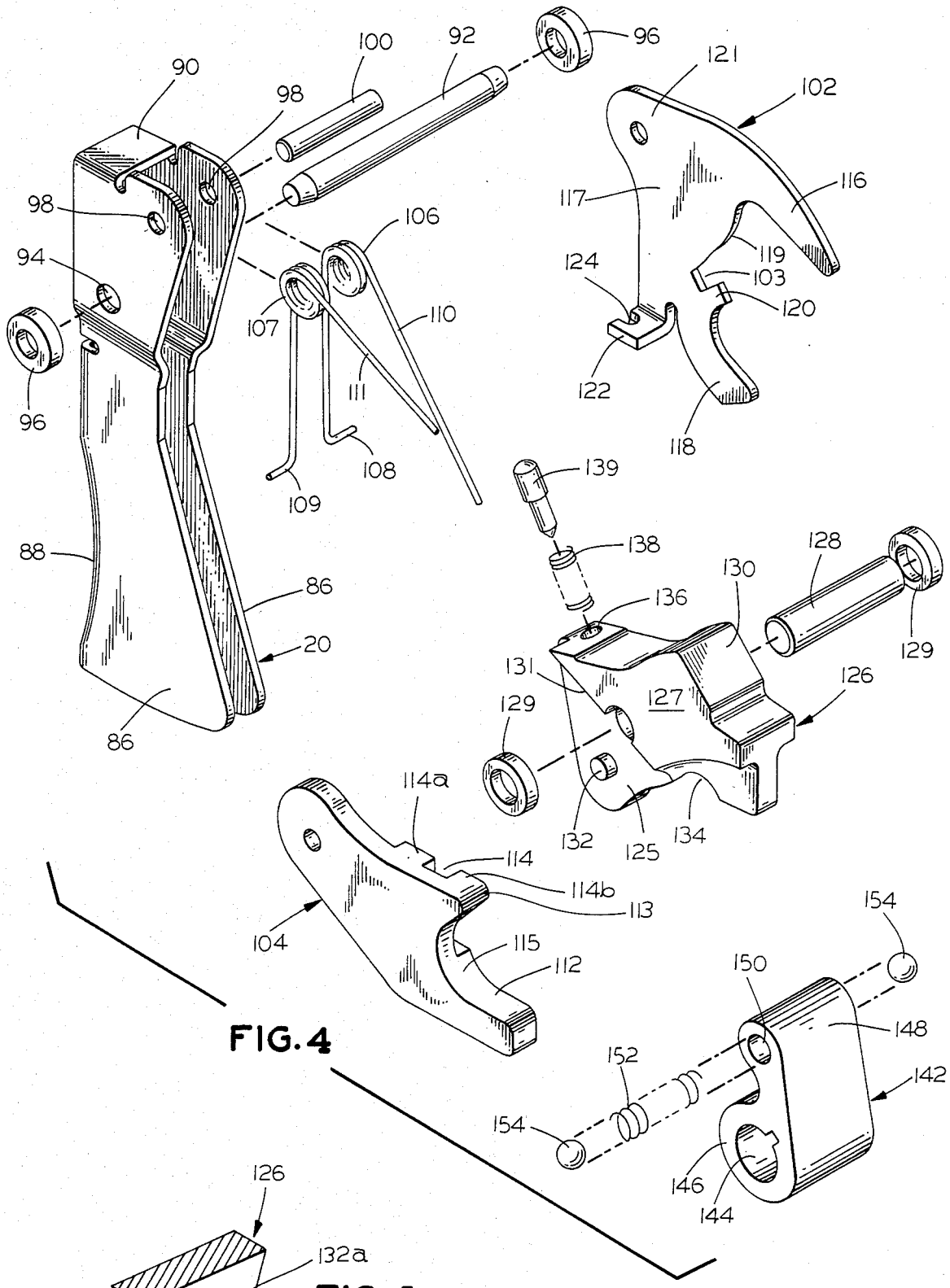
FIG. 4 is an exploded view of the trigger, sear and selector subassembly.
FIG. 5 is a fragmentary perspective view of the side of the sear opposite to that seen in FIG. 4.

Turning now to FIGS. 4, 6, and 15, the elements comprising the trigger, sear and selector subassembly are therein illustrated. The trigger 20 is a vertically elongated member of generally U-shaped cross section, with sidewalls 86 and a forward wall 88 providing a rearwardly opening channel. A top bridge 90 extends between the forward upper margins of the sidewalls 86. A trigger pivot pin 92 extends through pivot apertures 94 in the sidewalls 86, and through spacers 96 to seat in the pivot apertures 72 of the trigger frame 58.

Extending through the pivot apertures 98 at the rearward upper end of the trigger sidewalls 86 is a pivot pin 100 which pivotably mounts upon one side of the trigger 20 the forward end of the semi-automatic bar generally designated by the numeral 102, and, upon the other side, the full automatic bar generally designated by the numeral 104. Seated upon the pin 100 between the sidewalls 86 are a pair of springs 106, 107 having leg portions 108, 109, and 110, 111 with the forward leg portions 108, 109 bearing upon the rear edges of the trigger sidewalls 86.

Turning first in detail to the structure of the automatic bar 104, it is of elongated configuration with a concavely arcuate rear edge cam surface 115 defined between rearwardly extending arm portions 112, 113. A pair of inwardly extending bosses 114*a*, 114*b* define a channel 114 therebetween.

The semi-automatic bar 102 has a forwardly extending pivot portion 121 at its upper end providing the pivot aperture through which the pivot pin 100 extends. Extending from the inside surface adjacent the bottom of its forward end is a flange 122 with a notch 124 in its forward edge. The semi-automatic bar 102 has a rearwardly extending upper arm 116 and the overall upper surface defined by the upper arm 116, body 117 and pivot portion 121 is convexly arcuate. Extending downwardly and rearwardly from the lower portion of the body 117 is a lower arm 118 which has an upwardly and rearwardly projecting finger 120 thereon spaced from the body 117 and providing a recess 103 therebetween. The rear of the body 117 between the arms 116, 118 provides a generally convexly arcuate cam surface 119.

Disposed between the automatic bar 104 and semi-automatic bar 102 rearwardly of the trigger 20 is the sear generally designated by the numeral 126 and pivotally supported on the pivot pin 128 which has spacers 129 thereon and seats in the pivot apertures 70 of the trigger frame sidewalls 60, 62. The upper portion 127 has an upwardly extending sear cam surface projection 130 intermediate its length with a generally vertical shoulder at its lower rear surface. The lower portion 125 has a step inwardly on the side adjacent the automatic bar 104 to provide a reduced transverse dimension relative to the upper portion 127 and to provide a generally longitudinally extending shoulder 131 bisecting the pivot aperture. The upper portion 127 also has its lower rearward edge portion of reduced transverse dimension on both sides. A cylindrical boss 132 extends from the lower portion 125 on the side adjacent the automatic bar 104 into the channel 114 thereof. A semi-cylindrical boss 132*a* (seen in FIG. 5) extends from the side surface of the lower portion 125 adjacent the semi-automatic bar 102 and seats in the notch or recess 103 thereof defined between the finger 120 and the arcuate surface 119 of the body 117. The lower rearward surface portion has a recess 134 inwardly from its rearward end. Seated in a recess 136 in the forward end of the top surface is a spring 138 and a plunger 139 which is biased by the spring 138 against the top wall 64 of the trigger frame 58. As a result, there is produced a biasing pressure tending to rotate the sear 126 in a counterclockwise direction about its pivot pin 128.

The rearward leg portion 111 of the spring 107 seats in a notch (not shown) in the lower forward edge of the automatic bar 104 and biases it in a counterclockwise direction about its pivot pin 100. Similarly, the rearward leg portion 110 of the spring 106 seats in the notch 124 of the semi-automatic bar 102 and biases it in a counterclockwise direction about the pivot pin 100.

Figure 2:
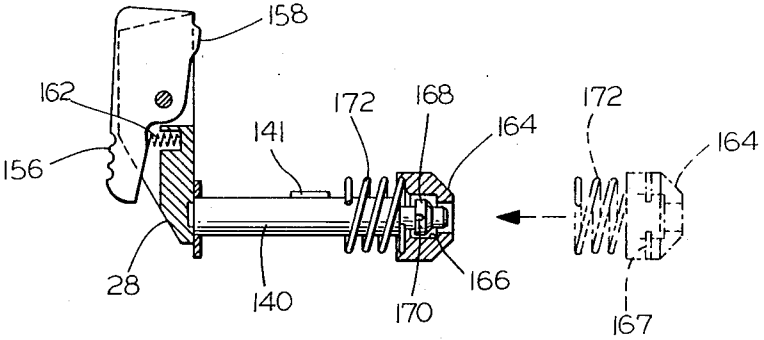
FIG. 2 is a rear elevational view of the selector switch subassembly with portions broken away and with the end cap shown disassembled in phantom line.

Turning now to the selector mechanism as seen in FIGS. 2, 4 and 6, the selector switch lever 28 is mounted on the shaft 140 outwardly of the trigger frame 58 and receiver housing 10. Mounted on the shaft 140 between the sidewalls 60, 62 of the trigger frame 58 is the selector generally designated by the numeral 142. The selector 142 has a body portion 146 with a generally arcuate periphery and an arm portion 148 with a convexly arcuate outer end portion. As seen, the shaft 140 has an axially extending key 141 along a portion of its length which seats in the narrow slot of the keyway shaped bore 144 of the body portion 146 of the selector 142. A bore 150 in the arm portion 148 contains a compression spring 152 and a pair of balls 154 which are thereby biased outwardly of its two sides against the sidewalls 60, 62 of the trigger frame 58 into one of the several detent apertures 76.

The selector switch lever 28 is elongated and has a slot extending longitudinally thereof in which is pivotably mounted a lock element 156 with a boss 158 on its inner edge. The boss 158 will seat in the full automatic position recess 160 in the receiver housing 10 (seen in FIG. 1) under the biasing pressure of the spring 162 acting on the end thereof to the opposite side of the pivot for the lock element 156.

On the other end of the shaft 140 outwardly of the receiver housing 10 is the end cap 164 which has a bore 166 into which project radially the pins 167 to interlock with two of the slots 170 of the collar 168. Two diametrically spaced slots 170 extend axially through the collar 168 to permit the pins 167 to pass therethrough, and two diametrically spaced slots 170 extend only partially through the collar and open at its inner end. In this fashion, the cap 164 may be fitted onto the shaft 140 with its pins 167 aligned with the full depth slots 170, and then rotated 90° to permit the pins 167 to seat in the partial depth slots 170. A compression spring 172 acts between the wall of the receiver housing 10 and the inside surface of the end cap 164 to hold the selector switch lever 28 tightly against the opposite sidewall of the receiver housing 10, and to hold the pins 167 of the cap 164 in the partial depth slots 170 of the collar 168 of the shaft 140.

Turning now in detail to the operation of the illustrated automatic weapon, the several elements are shown in the "safe" position in FIG. 6. Here the arcuate surface of the arm portion 148 of the selector 142 is disposed below the rearward lower surface of the sear 126, and the locking balls 154 seat in the detent apertures 76c of the trigger frame 58. As a result, the sear 126 cannot pivot in a clockwise direction. Because the boss 132a on the sear 132 is interlocked with the semi-automatic bar 102, it is also prevented from pivoting and it in turn precludes pivotal movement of the trigger 20 since it is pivotally connected thereto at its upper end. In this position, it should be noted that the shaft 140 is rotated so that the line drawn through its pivot axis and through the center of the radius for arcuate surface of the cam portion 148 is angled rearwardly relative to the vertical about 5°, and downward pressure on the arcuate surface of the arm portion 148 produces a wedging action which enhances the holding power of the selector 142.

Figure 10:
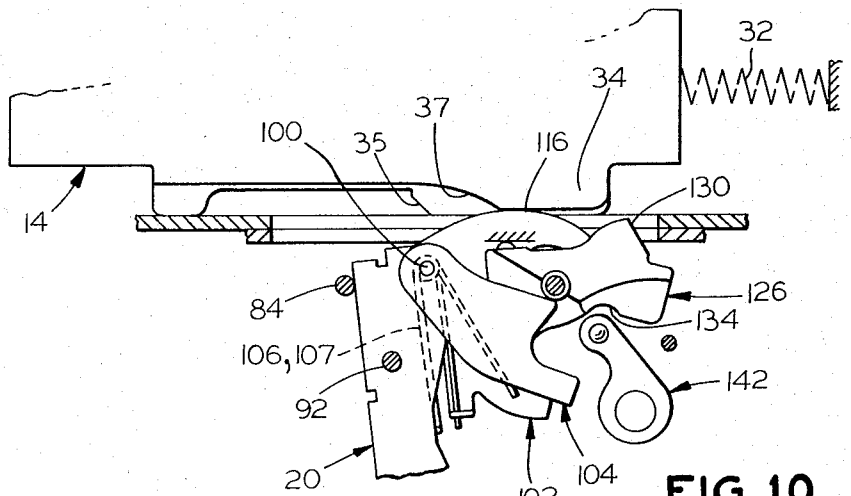
FIGS. 9–12 are a series of partially diagrammatic side views in partial section of the bolt, bottom receiver, trigger, sear, bars and selector, with the selector in the semi-automatic position and showing the parts in the several stages of the semi-automatic firing sequence.
Figure 9:
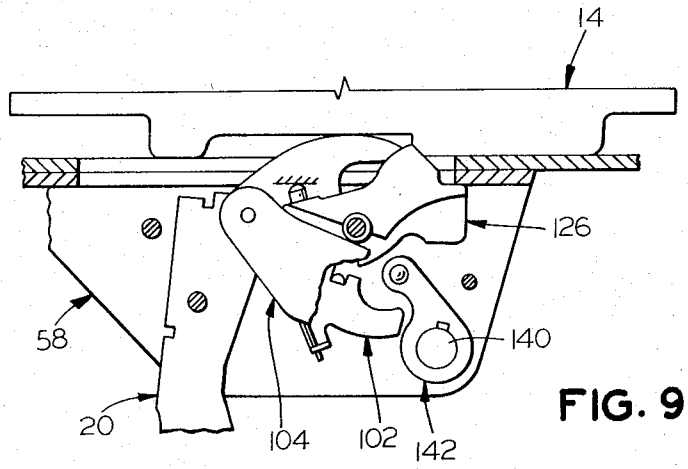
Figure 16:
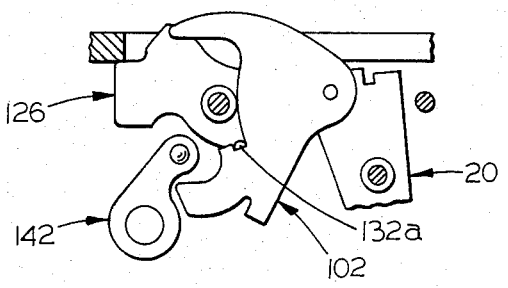
FIGS. 16 and 17 are diagrammatic views similar to FIGS. 9–12 showing the opposite side of several operating parts at two stages of the semi-automatic firing sequence.
Figure 17:
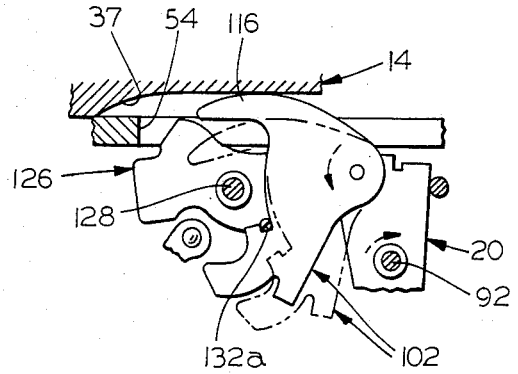

In the semi-automatic firing position, the selector switch lever 28 is pivoted to the semi-automatic position and the locking balls 154 seat in the detent apertures 76b of the trigger frame 58. In this position, the selector 142 is pivoted to the position illustrated in FIGS. 9 and 16 wherein it is spaced from the adjacent surfaces of the sear 126, semi-automatic bar 102 and automatic bar 104. When the lower end of the trigger 20 is pulled back, the upper end pivots in a counterclockwise direction about its pivot pin 92. Because the bars 102, 104 are pivoted to the upper portion of the trigger 20 by the pivot pin 100, they are pulled forwardly and upwardly. The boss 132a on the lower portion of the sear 126 is interlocked with the semi-automatic bar 102, and the movement of the semi-automatic bar 102 thus pivots the forward end of the sear 126 in a clockwise direction causing the sear projection 130 to move downwardly from the sear cavity 38 to the position seen in FIG. 17. Under the pressure of the bolt spring 32, the bolt 14 cams the semi-automatic bar 102 downwardly, or clockwise about its pivot pin 100 on the trigger 20 to the phantom line position in FIG. 17 and full line position seen in FIG. 10 as the bolt leg 34 passes thereover.

Figure 11:
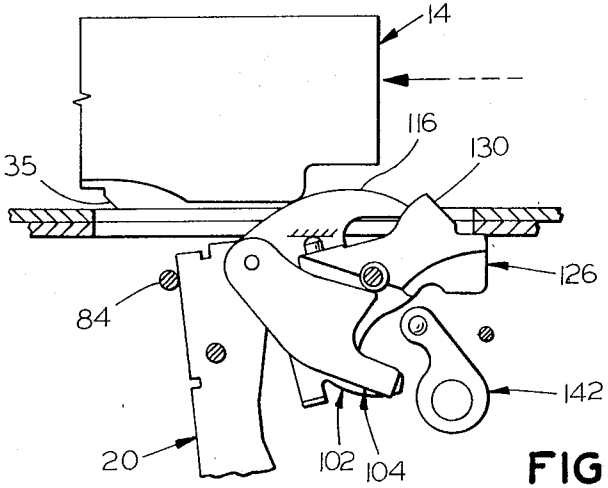

As the semi-automatic bar 102 pivots in the clockwise direction by the action of the bolt 14, the boss 132a on the sear 126 moves clear of the notch 103 of the semi-automatic bar 102 between the finger 120 and arcuate surface 119. The boss 132a moves relative to the arcuate surface 119 as the sear 126 rotates under the counterclockwise biasing pressure of the spring 138 and plunger 139 until its sear projection 130 is in the recess chamber in the position seen in FIG. 11. After the bolt 14 passes over the semi-automatic bar 102, the spring 106 rotates it in a counterclockwise direction to the position also seen in FIG. 11.

Figure 12:
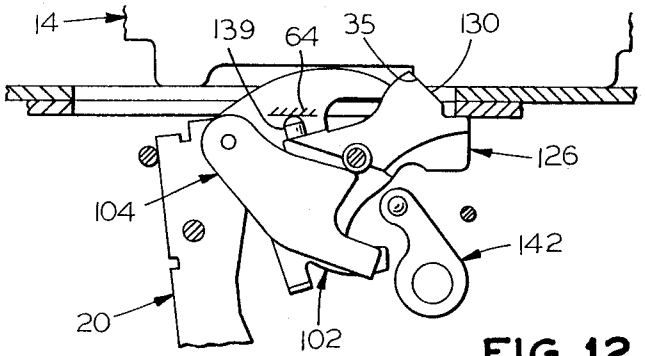

When the bolt 14 is driven rearwardly by the recoil action, both the semi-automatic bar 102 and sear 126 are cammed in a clockwise direction by the arcuate lower rear surface of the leg 34 and they then spring into the sear cavity 38 and the sear projection 130 locks with the latch surface 35 on the forward face of the leg 34 as seen in FIG. 12. To fire another shot, the trigger 20 must be allowed to pivot in a clockwise direction under the action of the springs 106, 107. Doing so causes the bars 102 and 104 to move rearwardly to their initial positions in which the boss 132a on the sear 126 reengages with the semi-automatic bar 102.

Figure 13:
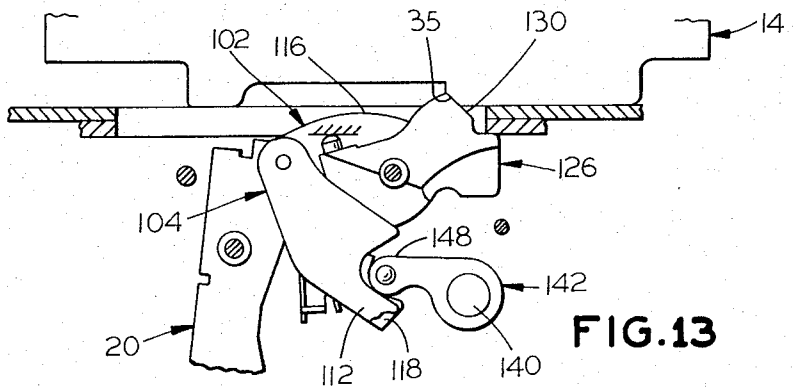
FIGS. 13 and 14 are similar partially diagrammatic views with the selector in the full automatic position and showing the parts in different stages of the automatic firing sequence.

In the full automatic position, the selector switch lever 28 is pivoted to its furthest counterclockwise position and the boss 158 on the lock element 156 seats in the automatic recess 160 in the receiver housing 10 under the biasing action of the spring 162. The locking balls 154 also seat in the detent apertures 76a of the trigger frame 58. As the selector 142 is being pivoted into this position, the arm portion 148 bears upon the lower arm portion 118 of the semi-automatic bar 102 and upon the finger portion 112 of the automatic bar 104. The movement of the selector 142 thus pivots the bars 102 and 104 clockwise about their pivot 100 into the position seen in FIGS. 13 and 18.

Figure 14:
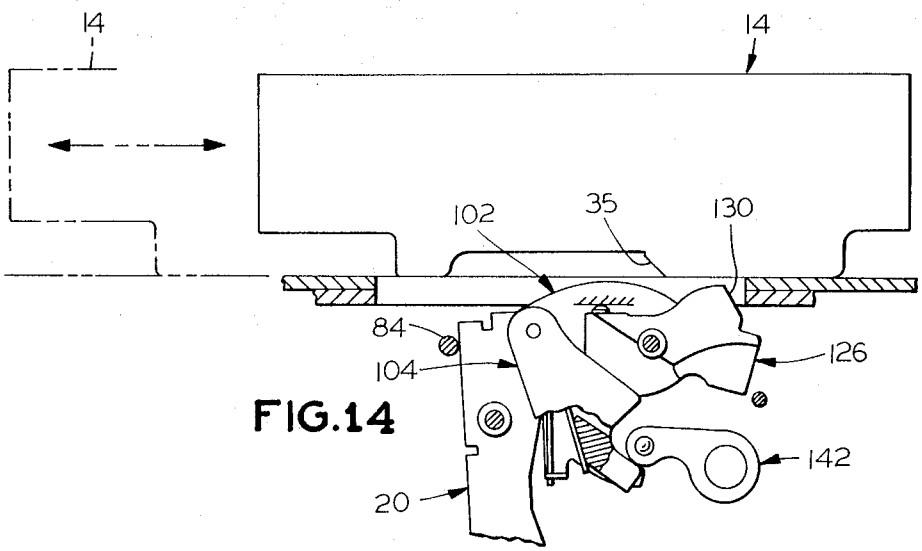
Figure 18:
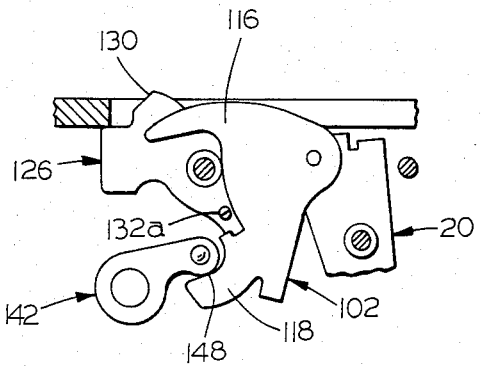
FIGS. 18 and 19 are diagrammatic views similar to FIGS. 13 and 14 showing the opposite side of several operating parts at two stages of the full automatic firing sequence.
Figure 19:
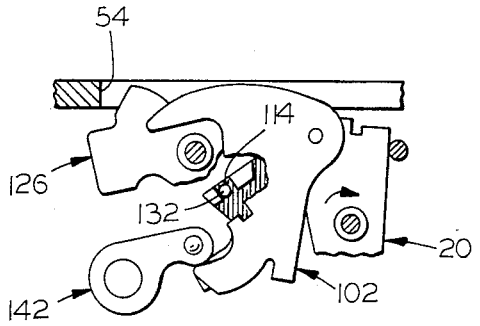

Because the bars 102, 104 are being pivoted in a clockwise direction while the trigger 20 is in its normal or at rest position, the lower arm portion 118 of the semi-automatic bar 102 moves downwardly and the boss 132a on the sear 126 moves out of the notch 103 therein as seen in FIG. 18 and the boss 132 enters into the channel 114 of the automatic bar 104. However, the sear cam projection 130 remains engaged with the bolt 14. When the trigger 20 is pulled, the engagement of the boss 132 within the channel 114 of the automatic bar 104 and the movement of the bar 104 forwardly moves the sear cam projection 130 downwardly to the position seen in FIGS. 14 and 19 and thereby permit the bolt 14 to move forwardly. So long as the trigger 20 is held in the pulled position, the bolt 14 reciprocates back and forth firing cartridges (not shown) being fed into the chamber of the barrel 16 from the magazine 22 in full automatic fashion. Upon release of the trigger 20, the sear 126 pivots counterclockwise under the action of the spring 138 and plunger 139 to place the sear cam projection 130 in the sear cavity 38 to engage and lock the bolt 14 in cocked position.

As will be apparent from the foregoing description, the sear member is engaged at any one time with only one of the automatic and semi-automatic bars to provide positive and long lived operation. Moreover, the arrangement of the bars being pivoted to the trigger and providing the engagement with the sear provides highly effective control over the sear operation and permits the sear to pivot upwardly rapidly into the receiver opening.

The selector mechanism requires no shifting of the trigger mechanism in any of its several positions and provides a secure lock for, the assembly in the safe positon. Moreover, the locking lever of the selector switch holds the selector in the full automatic position despite the vibrations caused by the high speed firing and bolt reciprocation.

Thus, it can be seen that the full automatic firearms of the present invention employ a novel and highly effective trigger, sear and selector mechanism to permit the bolt to be looked in the safe position and to be fired either automatically or semi-automatically. The sear is engaged at one time with only one of the pair of control bars to control its operation in response to pulling of the trigger, and the entire assembly is contained within a single housing unit which may be readily coupled to a receiver or firearm body. The several parts of this subassembly may be readily and economically fabricated and assembled, and exhibit long life and trouble-free operation.

It should be stated that the locking of the locking lever in the fully automatic position requires no additional movement of the hand. The lever snaps into the recess automatically. After firing stops, the lever can be depressed to allow rotation to either the semi-automatic or safe position.

Having thus described the invention, I claim:

1. In a firearm, the combination comprising:

A. a receiver having an aperture in its bottom wall;

B. a bolt which reciprocates within said receiver,

C. a housing affixed at its upper end to the bottom of said receiver and having spaced sidewalls depending therefrom and defining a cavity therewithin, said receiver aperture communicating with the upper portion of said housing cavity;

D. an elongated trigger member;

E. pivot means pivotally mounting said trigger member between said sidewalls of said housing for movement between a first and second position;

F. a sear member having a sear projection on its upper surface;

G. means pivotally mounting said sear member between said sidewalls of said housing for pivotal movement from a first position wherein said sear portion extends upwardly through said receiver aperture into said receiver for engagement with said bolt and to a second position wherein said sear portion is disposed below said receiver and not engageable with said bolt;

H. a semi-automatic bar in said cavity on one side of said sear member and having a cam surface on its upper edge portion;

I. means pivotally mounting said semi-automatic bar in said cavity for movement between a first position in which said semi-automatic bar extends through said aperture to locate said cam surface in said receiver for engagement by said bolt and a second position in which said bar is disposed below said receiver and is not engageable with said bolt;

J. an automatic bar in said cavity on the other side of said sear member;

K. means pivotally mounting said automatic bar in said cavity for movement between a first position and a second position;

L. cooperating engagement means on said sear member and on said automatic bar, said engagement means engaging said sear member in the second position of said automatic bar;

M. cooperating means on said sear member and on said semi-automatic bar for effecting engagement therebetween and concurrent movement of said sear member with said semi-automatic bar during initial movement of said semi-automatic bar from said one position thereof to said second position thereof, said cooperating means disengaging during said movement to release said sear member for return to its first position;

N. means engaging said bars with said trigger member for movement of said bars from said first and second positions thereof by pulling of said trigger;

O. a selector member in said cavity having a body and a cam portion;

P. means pivotally mounting said body of said selector member in said housing cavity for rotation about an axis among three positions, one of said positions being a safe position wherein said cam portion is disposed in close proximity to said sear member to prevent its pivoting from said first position to said second position thereof; a second pivoted position being one in which said cam portion is pivoted into a position free from operative engagement with said sear member, said semi-automatic bar and said automatic bar thereby permitting said sear member to pivot into said second position thereof in response to movement of said trigger to said second position thereof and thereby allowing said firearm to fire semi-automatically with said semi-automatic bar being cammed downwardly by forward movement of said bolt and releasing said sear member to pivot to its said first position to engage said bolt upon its recoil; and a third position in which said cam portion engages said semi-automatic bar and said automatic bar to pivot them into their respective second positions in which position thereof pivoting of said trigger to its said second position pivots said sear member into the second position by its engagement with said automatic bar to permit continuous reciprocation of said bolt so long as said trigger is retained in said second position thereof.

2. The firearm of claim 1 including a receiver housing and wherein said selector member includes a selector lever on said pivotal mounting means outwardly of said receiver housing on one side thereof and an end cap on said pivotal mounting means on the other side of said receiver housing.

3. The firearm of claim 1 wherein said selector member has a body portion which is pivotally mounted and an arm portion extending therefrom, said arm portion having a bore extending transversely thereof seating spring means and detent engaging means biased outwardly thereof by said spring means, said sidewalls of said housing having recesses in each of said positions of said selector member into which said detent engaging means are biased to releasably lock said selector member in each of said positions thereof.

4. The firearm of claim 1 wherein said automatic bar has a recess adjacent its upper edge and wherein said sear member has a projection engageable in said recess when said bar is in said second postiion thereof and said trigger is pulled.

5. The firearm of claim 1 wherein only one of said automatic and semi-automatic bars has its cooperating means engaged with said sear member at any given position of said sear member.

6. The firearm of claim 1 wherein said selector member has a body portion which is pivotally mounted and an arm portion extending therefrom and providing said cam portion.

7. The firearm of claim 6 wherein said arm portion has a convexly arcuate cam surface at its outer end.

8. The firearm of claim 7 wherein the line of action defined by the axis of said pivot means for said selector member and the center for said cam surface is angled from the vertical towards the rear of said firearm in said safe position and angled from the vertical towards the forward end of said firearm in said semi-automatic and automatic positions thereof.

9. The firearm of claim 1 herein said selector member has means thereon disengageably interlocking with said sidewalls of said housing in each of said several positions of said selector member.

10. The firearm of claim 9 including a receiver housing and wherein said selector member has a locking element on said selector member pivotal mounting means outwardly of said receiver housing interlocking with said receiver housing in said full automatic position.

11. The firearm of claim 1 wherein said semi-automatic bar has a pivot portion at its forward end and upper and lower arm portions on its rearward end.

12. The firearm of claim 11 wherein said lower arm portion has a recess therein and said sear member has a projection thereon seatable in said recess to provide said cooperating means thereon to effect engagement therebetween.

13. The firearm of claim 10 wherein said semi-automatic bar between said arm portions is curvilinear and said projection travels relative thereto upon release from said recess.

14. The firearm of claim 1 wherein said automatic and semi-automatic bar each have a rearwardly extending arm portion, said selector member cam portion being engageable with said arm portions during its movement to its said third position to effect pivoting thereof to their said second positions.

15. The firearm of claim 14 wherein said selector member has a body portion which is pivotally mounted on an arm portion extending therefrom and providing said cam portion, said cam portion having an arcuate cam surface at its outer end.

16. The firearm of claim 1 wherein said bar members are pivotally mounted on said trigger at a point above the pivotal means for said trigger whereby pulling of said trigger effects movement thereof in the direction of said trigger to effect counterclockwise pivoting thereof.

17. The firearm of claim 16 additionally including spring means acting between said trigger and said bars to bias said trigger in a clockwise direction and said bars in a counterclockwise direction.

18. The firearm of claim 16 wherein said trigger is of generally U-shaped cross section providing a channel opening towards said bars and where the pivotal connection of said bars to said trigger comprises a pivot pin upon which is mounted said biasing means in said trigger channel.

19. The firearm of claim 17 additionally including means biasing said sear member in a counterclockwise direction and into said receiver for engagment with said bolt.

* * * * *